US008197227B2

(12) United States Patent
Ernens

(10) Patent No.: US 8,197,227 B2
(45) Date of Patent: Jun. 12, 2012

(54) MULTI-STAGE COMPRESSOR SYSTEM

(75) Inventor: Philippe Alphonse Louis Ernens, Aubel (BE)

(73) Assignee: Atlas Copco Airpower, Naamloze Vennootschap, Wilrijk (BE)

( * ) Notice: Subject to any disclaimer, the term of this patent is extended or adjusted under 35 U.S.C. 154(b) by 683 days.

(21) Appl. No.: 12/302,997

(22) PCT Filed: Jun. 1, 2007

(86) PCT No.: PCT/BE2007/000053

§ 371 (c)(1),
(2), (4) Date: Dec. 1, 2008

(87) PCT Pub. No.: WO2007/137373

PCT Pub. Date: Dec. 6, 2007

(65) Prior Publication Data

US 2009/0257902 A1 Oct. 15, 2009

(30) Foreign Application Priority Data

Jun. 1, 2006 (BE) ..... 2006/0304

(51) Int. Cl.

| | |
|---|---|
| ***F04B 17/05*** | (2006.01) |
| ***F04B 23/00*** | (2006.01) |
| ***F01K 25/08*** | (2006.01) |
| ***F01K 23/10*** | (2006.01) |

(52) U.S. Cl. ..... 417/243; 417/203; 417/380; 417/405; 60/618; 60/653; 60/660; 60/670; 62/402

(58) Field of Classification Search ..... 417/243, 417/244, 205, 206, 410.3
See application file for complete search history.

(56) References Cited

U.S. PATENT DOCUMENTS

| | | | | |
|---|---|---|---|---|
| 2,875,589 | A | 3/1959 | Horn | |
| 3,640,646 | A * | 2/1972 | Hornschuch et al. | 417/203 |
| 4,342,201 | A | 8/1982 | Ishii | |
| 5,461,861 | A | 10/1995 | Wenzel | |
| 6,224,021 | B1 * | 5/2001 | Tanaka | 244/221 |
| 6,675,609 | B2 * | 1/2004 | Takeuchi et al. | 62/500 |
| 6,692,235 | B2 * | 2/2004 | Kolodziej et al. | 417/243 |
| 7,093,450 | B2 * | 8/2006 | Jimenez Haertel et al. | 62/91 |
| 2005/0193763 | A1 * | 9/2005 | Alford et al. | 62/510 |

FOREIGN PATENT DOCUMENTS

| | | |
|---|---|---|
| CN | 1402814 A | 3/2003 |
| DE | 42 34 393 C1 | 9/1993 |
| EP | 1 389 672 A1 | 2/2004 |
| FR | 2 476 240 | 8/1981 |
| JP | 56115896 | 9/1981 |
| JP | 60-111092 | 6/1985 |
| JP | 02238185 | 9/1990 |
| JP | 07071242 | 3/1995 |
| JP | 2002115505 | 4/2002 |

OTHER PUBLICATIONS

English translation of Examination Report of Japanese PTO regarding Japanese Application No. 2009-512376, Sep. 6, 2011. Examination Report of China IP Office regarding Chinese Patent Application 200780025667.5, Jun. 11, 2010.

* cited by examiner

*Primary Examiner* — Sikha Roy
(74) *Attorney, Agent, or Firm* — Bacon & Thomas, PLLC

(57) ABSTRACT

An improved multi-stage compressor device for compressing gas, which compressor device (1) mainly consists of at least two compressor elements (2-5-28) placed in series one after the other, at least one of which (5-28) is driven by a motor (9), characterized in that at least one other compressor element (2) is driven separately, in other words without any mechanical link with said motor (9), by means of an expander (18) of a closed power cycle (12) with a circulating medium inside which is heated by the compressed gas.

15 Claims, 3 Drawing Sheets

MULTI-STAGE COMPRESSOR SYSTEM

BACKGROUND OF THE INVENTION

1. Field of the Invention

This invention relates to an improved compressor device.

2. Related Art

It is known that in compressor devices, the temperature of the compressed gas can rise to a high level due to compression.

Much of the power that is needed to compress the gas is therefore converted into heat, and especially into latent heat in the compressed gas.

This conversion into heat is not usually put to any use and thus represents a loss, which has a negative effect on the efficiency of the compressor device.

An attempt is usually made to limit the heat which is generated in order to improve the efficiency and ensure that the compression occurs in the ideal manner, i.e. isothermally.

In practice, isothermal compression is difficult to achieve.

A known solution for limiting the heat generated during the compression of the gas is to inject a liquid coolant with a high heat capacity into the compressor element of the compressor device. For example, this is the case with so-called oil-injected and water-injected screw compressors.

However, in industrial compressors of this type the interaction time in the compressor element is very short, as a result of which the positive influence of the liquid injection in terms of efficiency is not particularly pronounced.

Another known solution for seeking isothermal compression is to have the compression take place in several steps with constantly increasing pressure, in successive, serially connected compressor elements, and to cool the compressed gas using an intercooler between successive steps.

An alternative is to recover the latent heat from the compressed gas for other useful purposes or applications, for example for use in a heating or similar installation.

However, such applications are not always convenient or necessary at the location.

Such applications are already known in which the heat of the gas is recovered and converted by means of a turbine into mechanical energy.

This mechanical energy is used, for example, to drive an electric generator, or is used to reduce the load on the motor which is used to drive the compressor device, so that a smaller motor can be used.

In this last case, the turbine is directly mechanically linked via its axle to the drive axle of said motor or of one or more compressor elements of the compressor device.

Because the compressor elements and turbine are mechanically linked, the choice of these components is restricted, as a result of which these components cannot each be optimised in its own right.

Moreover, although better overall efficiency is obtained through the heat recovery, the efficiency of the compressor device itself is not improved.

SUMMARY OF THE DISCLOSURE

The present invention relates to a compressor device with improved efficiency and more options for the optimisation of each individual component and hence too of the compressor device as a whole.

To this end, the invention relates to an improved multistage compressor device for compressing gas, which compressor device mainly consists of at least two compressor elements placed in series one after the other, at least one of which is driven by a motor, while at least one other compressor element is driven separately, in other words without any mechanical link with said motor, by means of an expander, for example a turbine, belonging to a closed power cycle with a circulating medium inside which is heated by the compressed gas, whereby the compressor element which is driven by the motor is of the screw type, while the compressor element which is driven separately by means of the expander of the closed power cycle is of the centrifugal type.

The compressed gas's latent heat is thus used to drive a component of the compressor device, using an efficient power cycle, preferably functioning according to the so-called Rankine cycle process, in which the hot gases, from the high-pressure compressor element function as a heat source.

In this way, the compressed gas's energy is recovered in an energy-efficient manner and used for the compressor device itself, as a result of which the compressor device's own efficiency is improved.

As the compressor element which is driven separately by the expander is decoupled from the compressor element which is driven by the motor, the compressor element which is driven by the expander can be driven at a different speed from the compressor element which is driven by the motor.

This thus additionally makes it possible to take advantage of the individual speeds of the two compressor elements so as to adjust the operating conditions of the two compressor elements separately according to the desired compressor capacity, the atmospheric conditions and so on.

Moreover, a compressor element can be chosen which can be driven directly at a high speed by the expander without the intervention of a transmission box or some similar element.

Since the compressor element which is driven by the turbine, is of a different type than that of the compressor element which is driven by the motor, so that in this respect an optimal choice is made.

In overall terms, all of this makes it possible to obtain improved efficiency from the compressor device as such.

The medium in the closed power cycle is pumped around by means of a pump, successively through: a heater which is made up of at least one heat exchanger through which at least part of the compressed gas flows; said expander which is connected with a said compressor element; and a condenser.

The medium is evaporated in the heater into a gas with high energy which drives the expander, for example a turbine, and hence also the compressor element which is linked to it, during which the gas in the expander undergoes expansion, after which the gaseous medium which leaves the expander is liquefied again at low pressure in the condenser, in order to then be sent by the pump again at an increased pressure through the heater and thus start a new cycle in the closed power cycle.

In this way the expander, for example a turbine, can be driven at very high speeds, which for example makes it possible to use a turbocompressor in a favourable manner as a compressor element which is driven by the expander.

BRIEF DESCRIPTION OF THE DRAWINGS

With a view to demonstrating the invention's characteristics more clearly, in what follows, by way of example and without any limitative intention, a number of preferred embodiments of an improved compressor device according to the invention are described, with reference to the accompanying drawings, in which.

DETAILED DESCRIPTION OF PREFERRED EMBODIMENTS OF THE INVENTION

Figure 1:
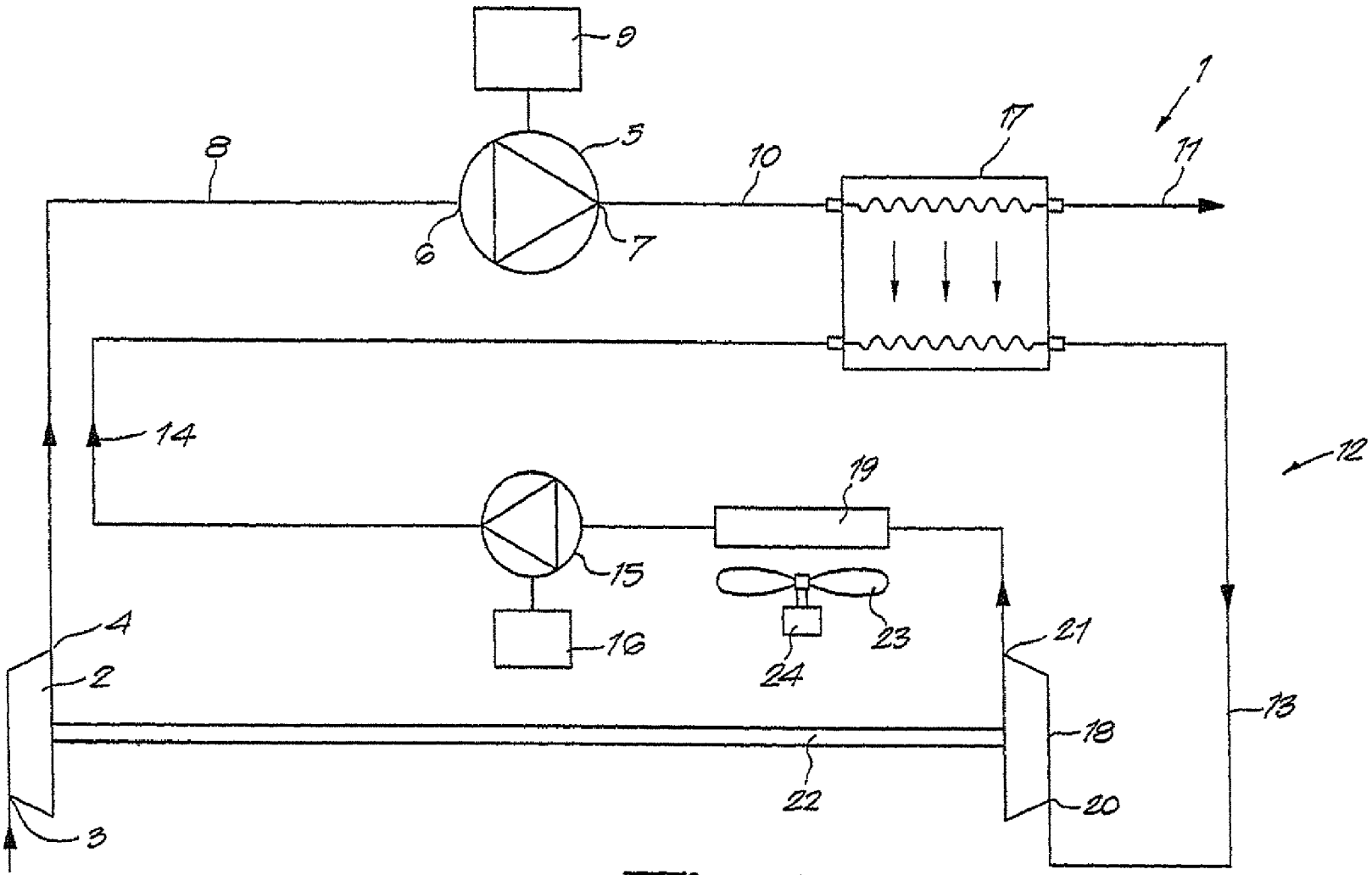
FIG. 1 is a diagrammatic representation of an improved compressor device according to the invention.

The compressor device 1 in FIG. 1 mainly consists of two compressor elements: a first compressor element 2 with an inlet 3 and an outlet 4 and a second compressor element 5, likewise with an inlet 6 and an outlet 7.

The compressor elements 2 and 5 are serially connected by means of a line 8 which connects the outlet 4 of the first compressor element 2 with the inlet 6 of the second compressor element 5.

The first compressor element 2 is upstream of the second compressor element 5, in terms of the direction of flow of the compressed gas, and works at lower pressures than the second compressor element 5, as a result of which these compressor elements 2 and 5 are also occasionally referred to as a low-pressure compressor element 2 and a high-pressure compressor element 5, which thus does not mean that the low pressure element must necessarily work at a low pressure.

The high-pressure compressor element 5 is driven by a motor 9, and in this case is connected via a pressure line 10 with a mains network 11 or similar.

The low-pressure compressor element 2 is in this case a component of the compressor device 1 which according to the invention is driven by a closed power cycle 12 which functions according to the principle of a Rankine cycle process.

The power cycle 12 consists in the depicted example of a closed loop 13 in which a medium such as pentane, water, $CO_2$ or any other suitable medium is pumped around in a particular flow direction 14, for example by means of a pump 15 which is driven by a motor 16.

The loop 13 contains successively, in the direction of flow 14 of the medium, a heater in the form of a heat exchanger 17, an expander 18, in this case in the form of a turbine 18, and a condenser 19.

Through the heat exchanger 17 flow the hot gases which come from the high-pressure compressor element 5, for which purpose the heat exchanger 17 is included in the pressure line 10.

The turbine 18 is fitted with an inlet 20 and an outlet 21 for the medium and is connected by means of transmission 22 with the incoming axle of the low-pressure compressor element 2, the foregoing points ensuring that the low-pressure compressor element 2 is driven separately from the high-pressure compressor element 5 without any mechanical linkage between the two compressor elements 2 and 5 or the motor 9 of the compressor element 5.

In the depicted example, both the low-pressure compressor element 2 and the turbine 18 are of the turbo type, as a result of which the transmission 22 can be a direct link by means of an axle. However, the possibility is not excluded that other types of compressor element or expander, and more particularly turbines, may be used, such as of the spiral type, of the screw type, and so on.

The condenser 19 is a heat exchanger for cooling the medium which flows through it, and in this case takes the form of air cooling which is provided by an external fan 23 with drive 24.

The working of the improved compressor device 1 is simple, and proceeds as follows.

The high-pressure compressor element 5 is driven by the motor 9 and delivers a particular flow of compressed gas which is delivered via the pressure line 10 and the heat exchanger 17 of the heater to the mains network 11.

Simultaneously with the compressor element 5, the pump 15 is also driven by means of the motor 16 so as to pump the medium round the loop 13 in the direction 14, in the process of which the medium is brought by the pump 15 to an increased pressure of, for example, 10 bar.

The medium flows in liquid form into the heat exchanger 17 of the heater, and is evaporated to a gaseous phase by the heat transfer in the heater 17.

The gas which is formed flows into the turbine 18 at a relatively high pressure and temperature.

In the turbine 18, the gaseous phase of the medium undergoes expansion, as a result of which the turbine 18 is driven at a high speed, as a result of which this turbine 18 will in turn drive the low-pressure compressor element 2.

As a result, the gas to be compressed is taken in via the inlet 3 and compressed in the low-pressure compressor element 2 to a certain intermediate pressure.

The medium leaves the turbine 18 at a considerably reduced pressure and temperature and is cooled in the condenser 19 in order to condense and reliquefy, as a result of which the reliquefied medium can be taken up and pumped around again by the pump 15 for the next operating cycle.

According to the application and the power rating, the various components can be adapted for the best result.

For a high-pressure compressor element 5 with an absorbed power of around 240 kW and a capacity in the region of 1000 liters per second and a compression ratio of 4.5, positive results have been obtained, for example, with an power cycle based on pentane with a turbine 18 with an expansion ratio of approximately 100, and at any rate greater than 50, which developed power in the region of 60 kW for driving the low-pressure compressor element 2 with a compression ratio of approximately 1.8.

Instead of pentane, another medium such as water or $CO_2$ may be used if necessary, preferably a medium with a relatively low boiling point which is lower than 150 degrees Celsius.

For the compressor, of course, all types of compressor may be used as a high-pressure compressor element, such as screw compressors, oil-free compressors and so on.

The turbine 18 and the low-pressure compressor element 2 also need not necessarily be of the turbo type, but can for example also be of the screw type or of the spiral type, and they may be all of the same type or each of a different type.

If a compressor element 2 of the high-speed turbo type is used, the volume of the compressor element 2 used may be much smaller than in the conventionally used compressor elements which need to be driven at a low speed, so that a compressor device according to the invention with such a compressor element 2 of the turbo type also takes less space than known compressor devices.

In combination with a motor 9 of the thermal type, such a compressor device is therefore highly suitable for a portable version of the compressor type.

The heater 17 and the expander 18 are preferably high-efficiency components which can operated with a small temperature difference.

The possibility is not excluded that the medium in the power cycle 12 may circulate as a result of the thermodynamic working of the cycle process, without a pump 15 being needed for this.

Figure 2:
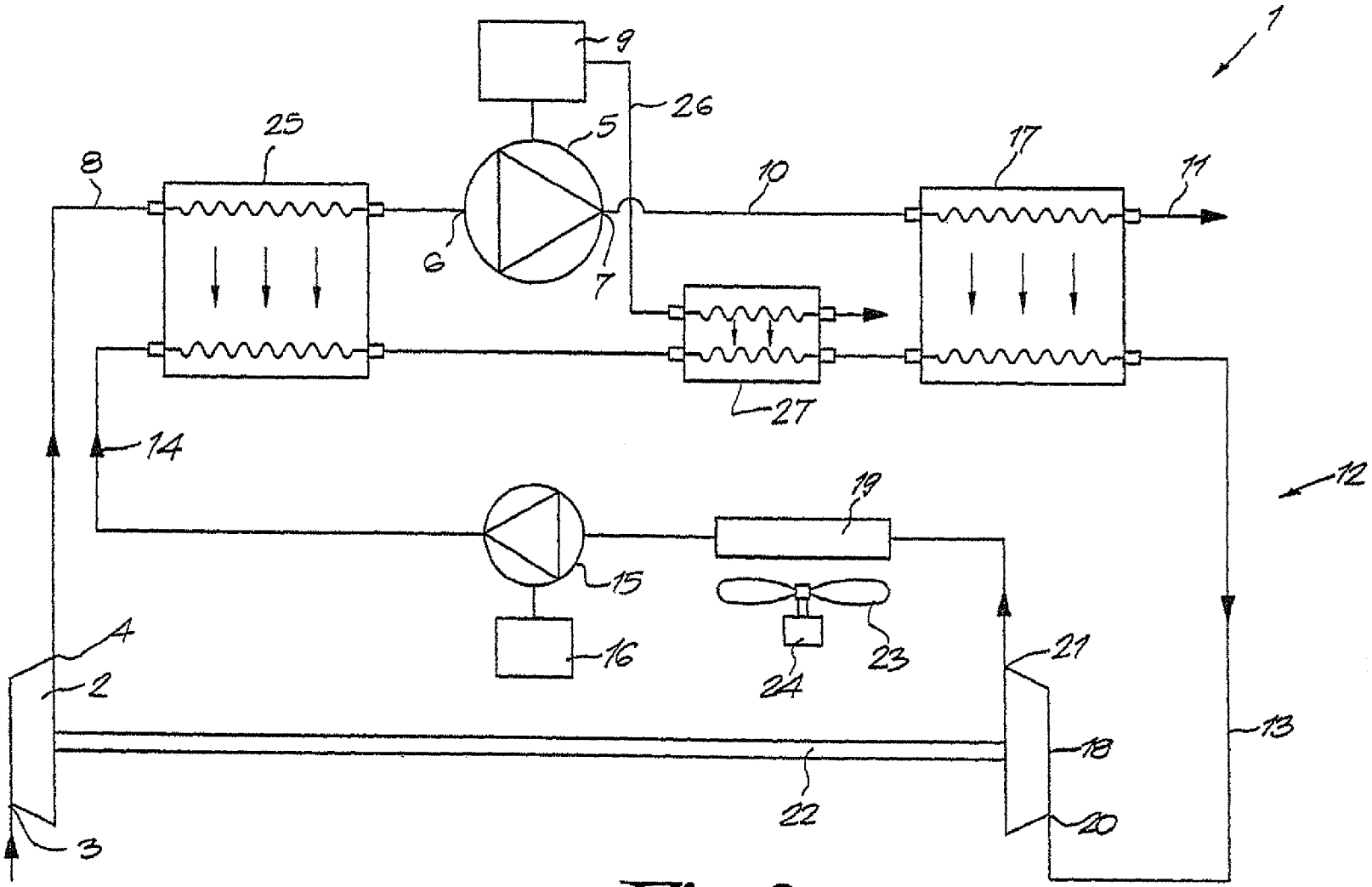
FIGS. 2 and 3 show a variant of FIG. 1.

In FIG. 2, a variant is shown of an improved compressor device according to the invention, which differs from the embodiment in FIG. 1 in that the heater in the closed power cycle 12 contains an additional heat exchanger 25 which is included upstream of the heat exchanger 17 in the power cycle 12.

This heat exchanger 25 takes the form of an intercooler which is included in the line 8 which connects the low-pressure compressor element 2 with the high-pressure compressor element 5.

By the use of this intercooler 25 the gas which is compressed in the high-pressure compressor element 5 is precooled, which has a positive effect on the efficiency of the high-pressure compressor element 5 and moreover provides an additional heat source which can supply energy to the medium in the power cycle 12.

The motor 9 to drive the high-pressure compressor element 5 is in this case a thermal motor whose exhaust gases are conveyed via an outlet line 26 through an additional heat exchanger 27, which is also included as a heater in the loop 13 for heating the medium in this loop 13.

In other respects, the workings of this variant are analogous to those of FIG. 1.

It is clear that the flow of compressed gas that is conveyed through the heat exchangers 17, 25 and 27 need not necessarily be the complete flow that is delivered by compressor elements 2 to 5.

As an alternative version, the heater can consist of just one of the heat exchangers 17, 25 and 27.

Depending on whether the temperature of the exhaust gases in the outlet line 26 is higher or lower than the temperature of the compressed gases in the pressure line 10, the heat exchanger 27 may be included upstream or downstream of the heat exchanger 17 in the loop 13.

Figure 3:
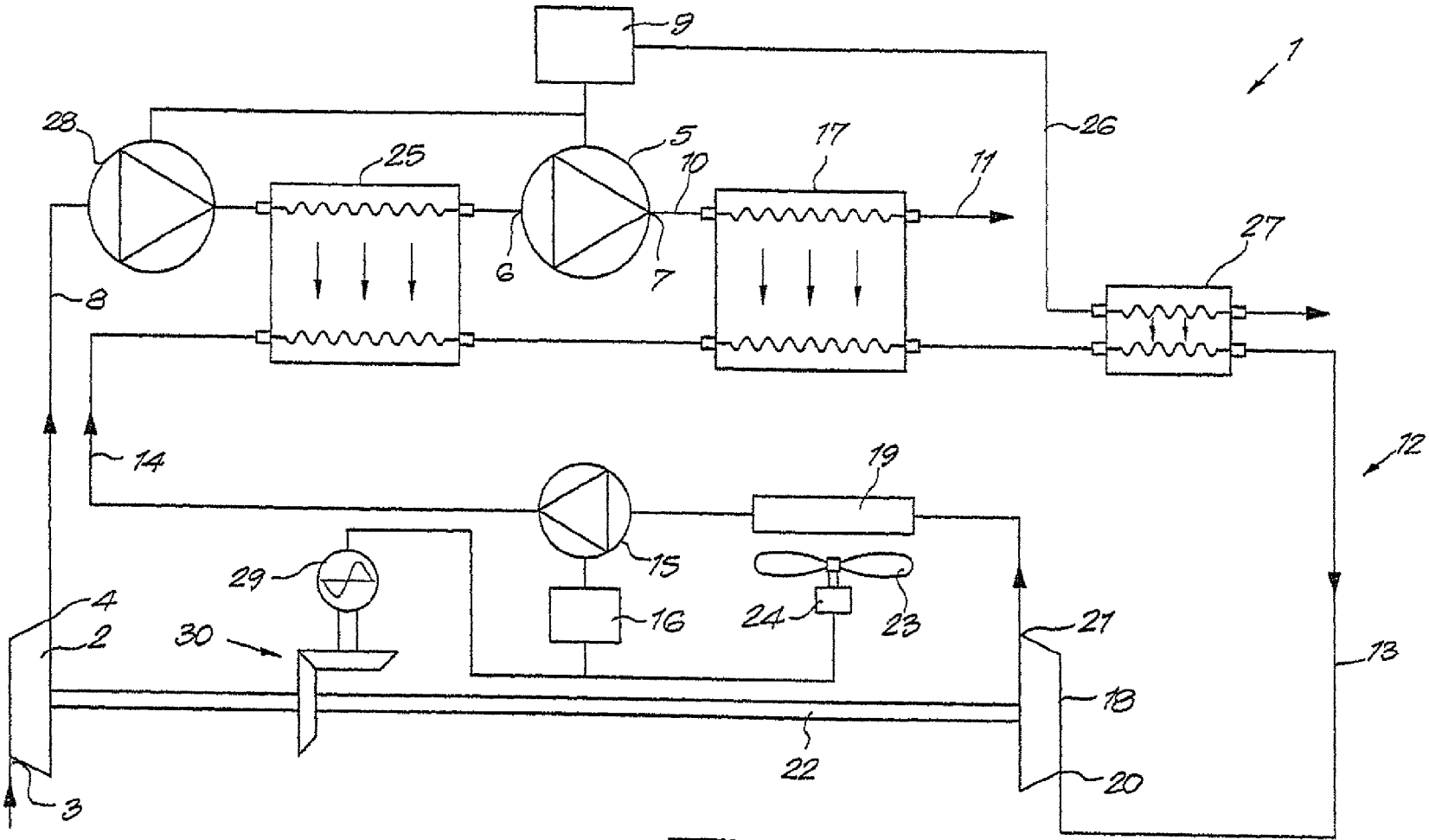

In FIG. 3, a variant is shown of such a compressor device according to the invention, in which the heat exchanger 27 is positioned downstream of the heat exchanger.

In FIG. 3, the invention is applied to a multi-stage compressor device 1 with an additional compressor element 28 which is placed in series between the low-pressure compressor element 2 and the high-pressure compressor element 5, with the heat exchanger 25 taking the form of an intercooler in order to cool down the gas which is compressed by the compressor 28 before it is taken up by the high-pressure compressor element 5 for further compression.

Additionally, a generator 29 is fitted in the compressor device 1 in FIG. 3, which generator is driven by means of a transmission 30 by the turbine 18 and supplies current for driving other components of the compressor device, such as the motor 16 and the drive 24 of the pump 15 and the fan 23 respectively, or for example of an additional air dryer or additional fans for the heat exchangers 17, 25 and/or 27.

According to an alternative embodiment which is not shown in the figures, the turbine 18 is exclusively used to drive the generator 29.

Although the figures show embodiments of a compressor device according to the invention in which the compressor element 2 driven by the expander 18 is located upstream of the compressor element 5 which is driven by the motor 9, the possibility is not excluded that this compressor element 2 could be positioned downstream of the compressor element 5.

The present invention is in no way restricted to the embodiments described by way of example and shown in the figures, and an improved compressor device according to the invention may be produced in various different forms and dimensions without going beyond the scope of the invention.

The invention claimed is:

1. A multi-stage compressor system for compressing gas, comprising:

a plurality of compressor elements (2-5-28) discharging compressed and heated gas during operation located in series one after the other, said compressed gas circulating between said compressor elements;

one of said compressor elements (5-28) being driven by a motor (9), and at least another one of said compressor elements (2) being driven separately without a mechanical link with said motor (9);

wherein the one compressor element (5-28) which is driven by the motor (9) is of the screw type, and the other compressor element (2) which is driven separately is of the centrifugal type;

an expander (18) included in a closed power cycle (12) using a circulating medium inside the power cycle and drivingly connected to said other compressor element;

a heater arranged to receive and heat said circulating medium;

said heater arranged to receive at least part of the compressed and heated gas discharged from a compressor element and to heat the circulating medium in said heater using said compressed and heated gas.

2. The compressor device according to claim 1, wherein the other compressor element (2), which is driven separately by the expander (18) is located upstream of the one compressor element driven by the motor relative to the direction of circulation of compressed gas.

3. The compressor device according to claim 1, wherein the motor (9) comprises a thermal motor.

4. The compressor device according to claim 1, wherein the circulating medium in the closed power cycle (12) is circulated by means of a pump (15), successively through: said heater, which comprises at least one heat exchanger (17-27-25) through which the at least part of the compressed and heated gas discharged from a compressor element flows; said expander (18) which is connected with said other compressor element (2); and a condenser (19).

5. The compressor device according to claim 4, wherein said at least one heat exchanger is included in a pressure line (10) of a last compressor element (5) of the multi-stage compressor device.

6. The compressor device according to claim 4, wherein said at least one heat exchanger comprises an intercooler (25) located in a compressed gas line (8) which connects said one and other compressor elements (2-5) to each other and arranged to cool compressed and heated gas circulating in said line.

7. The compressor device according to claim 4, including a drive comprising a thermal motor (9) with an outlet exhaust line (26) discharging the exhaust gases from the motor and wherein said heater in the closed power cycle (12) includes an additional heat exchanger (27) which is included in said outlet exhaust line (26).

8. The compressor device according to claim 4, wherein the expander (18) is of the turbo type.

9. The compressor device according to claim 4, wherein the expander (18) is of the screw type.

10. The compressor device according to claim 4, wherein the expander (18) is of the spiral type.

11. The compressor device according to claim 4, wherein the other compressor element (2) driven by the expander (18) has a compression ratio in the region of 1.8.

12. The compressor device according to claim 1, wherein the medium in the power cycle (12) comprises a low boiling point medium.

13. The compressor device according to claim 1, wherein at least one of said compressor elements (2-5-28) is of the oil-free type.

14. The compressor device according to claim 1, wherein the one compressor element (5) driven by a motor has a compression ratio in the region of 4.5.

15. The compressor device according to claim 1, wherein the compressor device is portable.

* * * * *